United States Patent [19]

Sano et al.

[11] 4,003,307

[45] Jan. 18, 1977

[54] PRINTER

[75] Inventors: Seizaburo Sano; Takaaki Kozima, both of Yokohama, Japan

[73] Assignee: Amano Corporation, Yokohama, Japan

[22] Filed: Oct. 15, 1974

[21] Appl. No.: 514,609

[52] U.S. Cl. ..... 101/45; 101/270; 346/87

[51] Int. Cl.[2] ..... B41L 47/46

[58] Field of Search ..... 101/45, 91, 269, 270; 197/51; 346/20, 87

[56] References Cited

UNITED STATES PATENTS

| | | | |
|---|---|---|---|
| 2,019,301 | 10/1935 | Friden | 346/87 X |
| 2,268,924 | 1/1942 | Cooper | 346/87 |
| 2,690,710 | 10/1954 | Aurbach | 101/91 |
| 3,371,349 | 2/1968 | Schinner et al. | 101/269 X |
| 3,381,790 | 5/1968 | Chaveneaud et al. | 197/51 |
| 3,484,326 | 12/1969 | Grandinetti | 101/269 X |
| 3,560,990 | 2/1971 | Inoue | 346/20 |
| 3,626,463 | 12/1971 | Foerster | 101/45 X |
| 3,661,080 | 5/1972 | Laws | 101/269 |

*Primary Examiner*—Anton O. Oechsle
*Attorney, Agent, or Firm*—Hans Berman

[57] ABSTRACT

A time card printer comprising a plurality of type wheels rotatably mounted on a common supporting shaft and a plurality of printing rolls radially aligned with respective type wheels, the printing rolls being mounted on a common drive shaft which rotates in response to insertion of a time card and is parallel to the supporting shaft, each printing roll pressing the inserted time card against the type surface of the corresponding type wheel during rotation of the drive shaft, the printing rolls being moved against the corresponding type wheels one after the other.

2 Claims, 19 Drawing Figures

FIG.8A
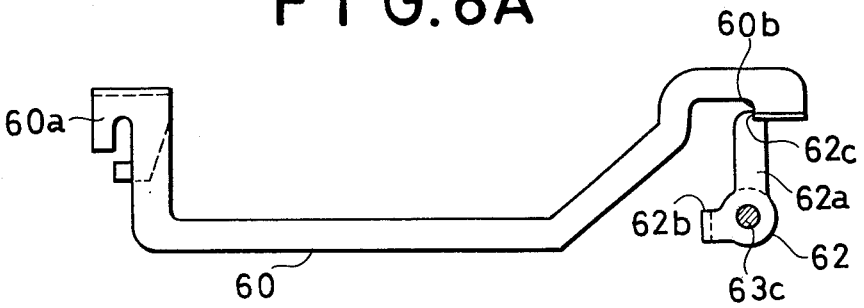
FIG.8B
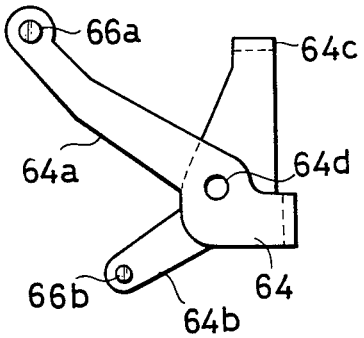
FIG.8C
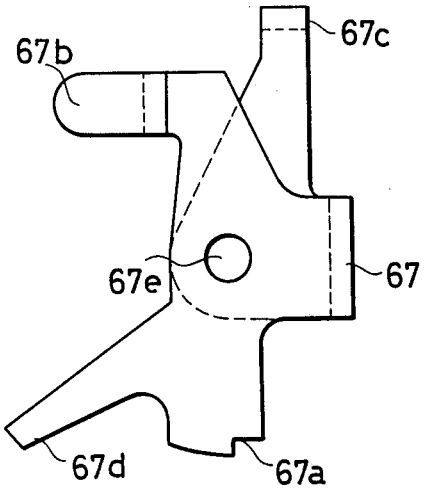
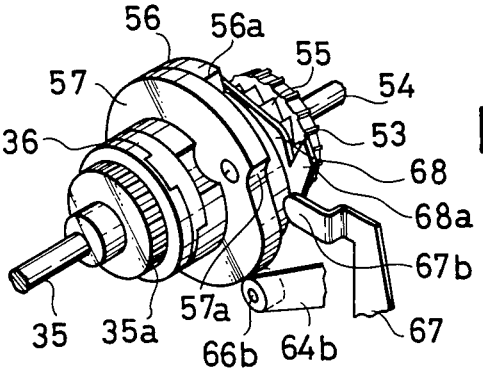
FIG.9

PRINTER

This invention relates to a printer suitable for various types of printing machines such as time stamps or time recorders.

The printers generally used in time stamps or time recorders employ a percussion printing system using a hammer or a transfer printing system using a printing roll. According to these known printing systems, a hammer or roll is pressed against type surfaces of type wheels arranged side by side on a type shaft, thereby to print letters on a printing card.

It is essential that the type wheels mounted on the type shaft are of the same diameter and concentric with the shaft. If a hammer or a printing roll is moved against type wheels with non-aligned type surfaces, some type surfaces are printed sharp while others are printed weak and dim. The same problem is caused when the hammer or printing roll is not moved against the type wheels at right angles to their axis or when the types are partly worn off.

Basically, the problem is due to the fact that only a single hammer or printing roll cooperates with the several type wheels. The primary object of the present invention, therefore, is to provide a transfer type printer comprising a plurality of printing rolls, one roll being provided for each type wheel.

According to the present invention, the type wheels are rotatably mounted on a common type shaft, and printing rolls associated with respective type wheels are mounted on a printing roll shaft provided in a printing block secured to a base in such a manner that the printing roll shaft is parallel to the type shaft. The printing rolls are offset relative to the roll shaft both in a circumferential direction and in an axial direction. When the roll shaft rotates, the rolls engage the type surfaces of the associated type wheels successively.

Because two or more rolls cannot act simultaneously on one type surface, each type surface receives the full pressing force of the corresponding printing roll unaffected by other type surfaces, thus allowing uniform and clear printing on a printing card. The quality of the printing is affected little if the type wheels differ in diameter or deviate from a concentric arrangement.

There is also provided on the printing block another shaft, and fixedly mounted on the other shaft is a pressure roll disposed adjacent the type rolls so as to press against a flat die plate after the printing rolls have successively pressed against the respective type wheels. Therefore, it is possible to print on the printing card types which change with the angular positions of the type wheels, and types from the fixed die plate, such as a mark or a firm name.

Resilient pressure is applied to the printing block on which the two roll shafts are secured, so as to press each roll against the type face of the corresponding type wheel or die plate.

A passage for inserting a printing card is provided between the type wheels and die plate and the rolls, and in this passage lies a lever. When a printing card is inserted to move the lever, a switch starts a motor to rotate the printing roll shaft. When the printing roll shaft completes a revolution, a cam device turns the switch off to stop the motor, and the roll shaft is stopped.

A preferred embodiment of the invention is illustrated in the accompanying drawings as adapted to a time stamp, but the printer of the present invention can be applied to various other types of printing apparatuses such as for example time recorders.

In the accompanying drawings:

FIG. 8A is a front view of elements shown in FIG. 8;

FIG. 8B is a front view of a lever in the device of FIG. 8;

FIG. 8C is a front view of a switch operating member in the device of FIG. 8;

FIG. 9 is a perspective view, with parts cut away, showing a cam mechanism for actuating the lever and the switch operating member.

The printer according to the present invention comprises, as its principal elements, a printing mechanism including the printing rolls, a type mechanism actuated by the printing mechanism, and a driving mechanism which operates the printing mechanism.

Figure 1:
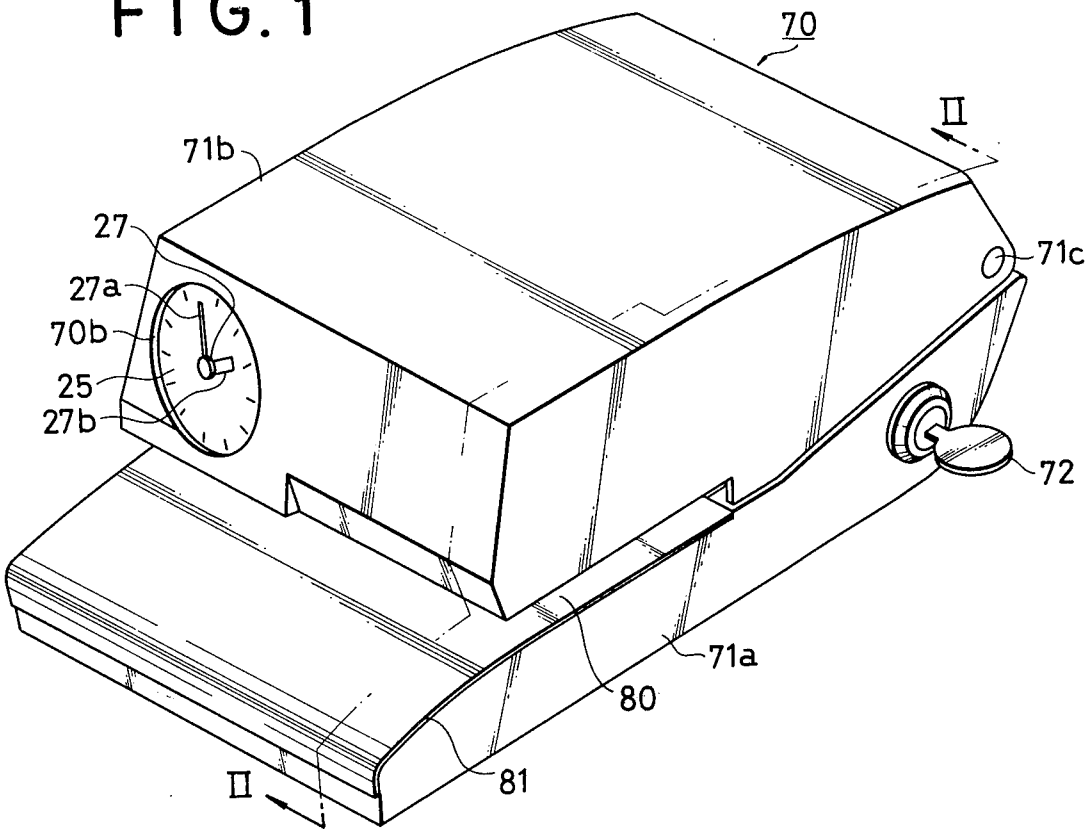
FIG. 1 is a perspective view of a time stamp in which a printer according to the present invention is incorporated.
Figure 2:
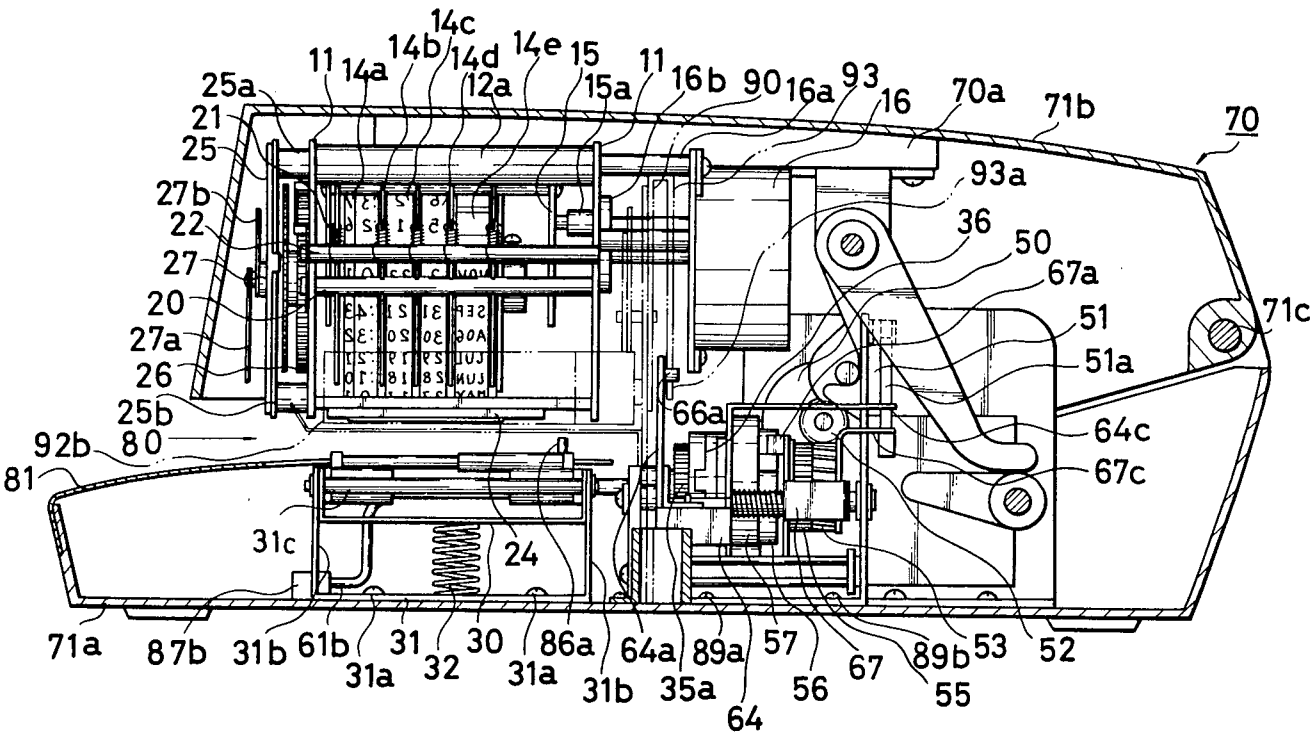
FIG. 2 is a sectional view of the time stamp taken along the line II — II of FIG. 1.
Figure 6:
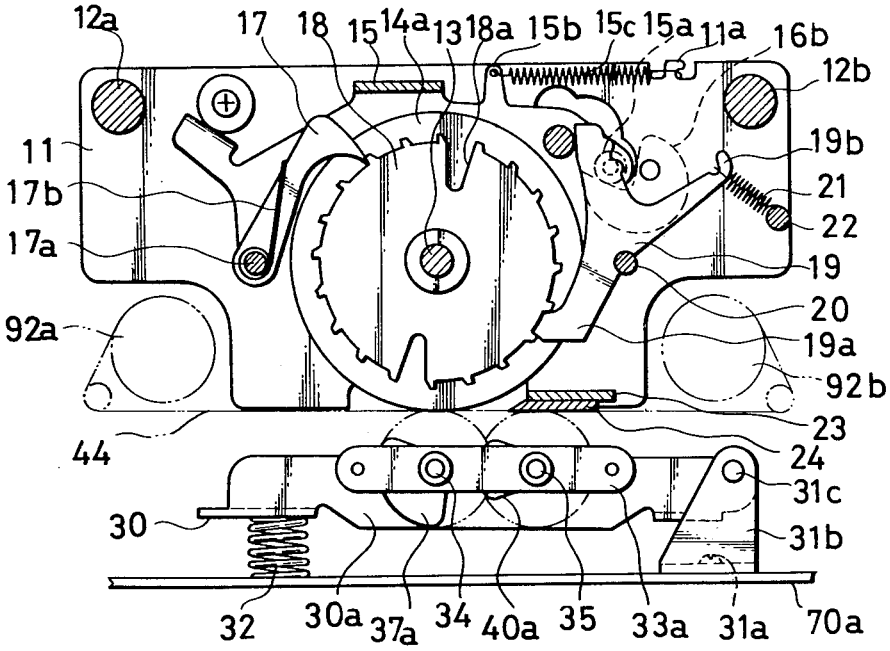
FIG. 6 is a front view, with parts shown in section, showing the positional relation between the printer and the type assembly.

The type mechanism is conventional. As best shown in FIGS. 2 and 6, it includes two parallel frame plates 11 connected by two rods **12*a*, 12*b*, and a type shaft 13 fixed centrally between the two frame plates. Mounted on the type shaft 13 about a common first axis in axially juxtaposed relationship are five type wheels: a minute wheel 14*a* whose peripheral face carries two groups of numbers 0 to 9, a ten minute wheel 14*b* whose peripheral face carries numbers 0 to 6, an hour wheel 14*c* similarly carrying numbers 0 to 23, a date wheel 14*d* inscribed with numbers 1 to 31, and a month wheel 14*e*** inscribed with numbers 1 to 12.

This type mechanism also includes a frame 15 pivotally secured to the shaft 13 and a synchronous motor 16 fixed by a bar **16*a* to one of the frame plates 11. An operating stem 15*a* projecting from the frame 15 is positioned within range of a cam 16*b* which is turned by the motor 16 through one full revolution in one minute, thereby turning the frame 15 counterclockwise (in FIG. 6) once in one minute about the shaft 13 against the restraint of a return spring 15*c* arranged between a lug 15***b* of the frame 15 and a lug 11*a* on one frame plate 11.

To the type wheels 14*a* – 14*e* are concentrically fixed respective ratchet wheels 18 driven by pawls 17 which are pivoted by a shaft 17*a* to the frame 15 and each provided with a pawl spring 17*b*. Only the pawl which shifts the minute wheel 14*a* is in constant contact with the corresponding ratchet wheel and drops into a radial recess 18*a* in the ratchet wheel shown in FIG. 6 at the tenth step whereupon the pawl associated with the next wheel 14*b* is contacted with the corresponding ratchet wheel. The wheels 14*c* to 14*e* are advanced successively in this way.

Five stoppers 19 respectively associated with the ratchet wheels 18 are rotatably mounted on a supporting shaft 20 between the frame plates 11, the free end 19*a* of each stopper being engaged with the corresponding ratchet wheel 18 to prevent backward turning. A spring 2 connecting an arm portion 19*b* of each stopper 19 with a shaft 22 between the plates 11 holds the stopper engaged with the corresponding ratchet wheel.

A mounting plate 23 is secured between the lower portions of the frame plates 11, and a die plate 24 carrying types indicating the firm name or like is attached to the die plate by non-illustrated screws.

A dial or face plate 25 of a clock is secured to a frame plate 11 by means of pins 25*a*, 25*b*. A shaft 27 projects centrally from the clock face and is secured to a gear 26 which is advanced once a minute through a driving mechanism by the frame 15. The tip of the operating shaft carrier are a long hand 27*a* and a short hand 27*b* which indicate time.

The printing mechanism will now be described with particular reference to FIG. 3, FIG. 6, and FIGS. 7A to 7D.

A frame-shaped support or printing block 30 is provided in its center with a large cut-out 30*a* and supported at its one end by a shaft 31*c*. The ends of the shaft 31*c* are journaled in brackets 31*b* secured by screws 31*a* to the base 71*a* of the time stamp. A helical compression spring 32 is disposed between the other end of the printing block and the base 71*a*.

Two bearing plates 33*a*, 33*b* are mounted on respective lateral flanges 30*b* of the printing block, and two printing roll shafts 34 and 35 are rotatably mounted between the bearing plates. Fixedly mounted on the outer end of one of the roll shafts 34 is a gear 34*a* which is meshed with a drive gear 35*a* mounted on the outer end of the other roll shaft 35. Also provided at the outer end of the roll shaft 35 is a universal joint 36 linked to the driving mechanism, which is to be described later. When the universal joint 36 rotates, the printing roll shafts 34 and 35 rotate in opposite directions (see arrows in FIG. 7A) without being affected by up and down movement of the printing block 30.

Fitted on the printing roll shafts 34 and 35, whose axes extend in a common direction with the axis of the type shaft 13, are the substantially fan-shaped mounting elements 37*a*, 37*b* and 40*a*, 40*b*. Disposed between the mounting elements 37*a* and 37*b* are four supporting shafts 38*a*, 38*b*, 38*c*, and 38*d* whose axes are equidistant from and parallel to the axis of the printing roll shaft 34. Mounted on respective shafts 38*a* – 38*d* are the printing rolls 39*a*, 39*b*, 39*c*, 39*d* which are rotatable individually but immovable axially. The rolls are offset from each other in an axial direction so that the rolls are generally arranged in a spiral pattern.

Supporting shafts 41*a*, 41*b* are mounted between mounting elements 40*a* and 40*b* and parallel to the shaft 35. On the supporting shafts are rotatably mounted the printing or pressure rolls 42*a*, 42*b* which are longer than the printing rolls 39*a* – 39*d* and offset relative to each other axially of the printing roll shaft 35 as shown in FIG. 7C. In FIG. 7C, there are seen collars 42*c*, 42*d* on the shafts 41*a* and 41*b* which prevent axial movement of the printing rolls 42*a*, 42*b*.

Figure 7A:
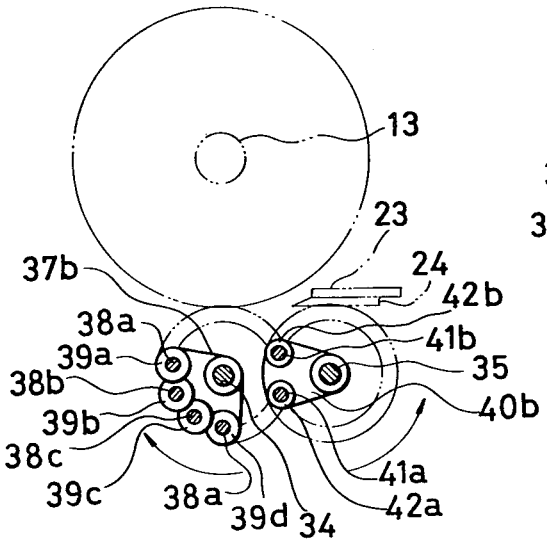
FIG. 7A illustrates, partly in section, the printing rolls, type wheels and die plate, which constitute the essential portion of the present invention.
Figure 7B:
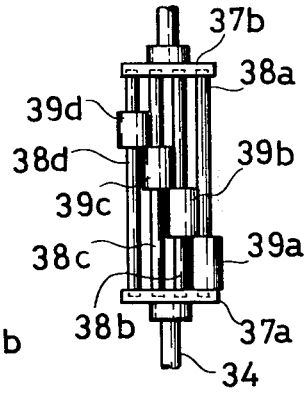
FIG. 7B is a bottom view of the printing roll assembly.
Figure 7C:
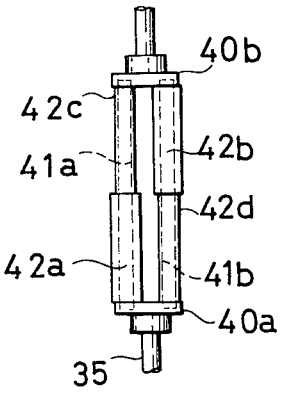
FIG. 7C is a bottom view of the other roll assembly.
Figure 7D:
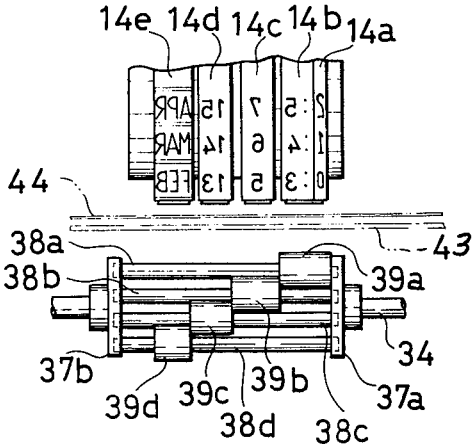
FIG. 7D is a side view, with parts cut away, of the printing rolls and the type wheels.

Both shafts 34 and 35 are disposed below and parallel to the type shaft 13 as shown in FIGS. 6 and 7A. The printing rolls are arranged so that roll 39*a* is radially aligned with the minute wheels 14*a*, 14*b*, roll 39*b* is aligned with the hour wheel 14*c*, roll 39*c* with the date wheel 14*d*, and roll 39*d* with the month wheel 14*e* during rotation of the printing roll shaft 34. The printing rolls 42*a* and 42*b* on the other shaft 35 press against the die plate 24 when the shaft 35 turns.

The rolls 39*a* – 39*d* are angularly so positioned on the shaft 34 that the final printing roll 39*d* will complete its pressing action against the month wheel 14*e* when the shaft 34 has turned about 180° from the position shown in FIG. 7A. On the other hand, the first printing roll 42*a* on the shaft 35 will begin to push against the die plate 24 only when the shaft 35 has turned about 245° from the position of FIG. 7A. Thus, these printing rolls are arranged so that two or more rolls cannot press type faces simultaneously.

In this way, the spring 32 biasing the printing block 30 and the printing roll shafts 34, 35 toward the type wheels 14*a* – 14*e* and the die plate 24 acts substantially separately on each of the printing rolls to properly load each face, allowing uniform and clear printing on the printing card 43 regardless of variations in diameter of the type wheels or unevenness of the type surfaces caused, for instance, by partial wear of the types.

The printing card 43 is inserted in a space defined between the printing rolls and the type group consisting of the type wheels and the die plate, and types are printed on the inserted card through a printing ribbon 44 interposed between a card surface and the type group. The feed mechanism for the printing ribbon 44 will be described later.

When the printing roll shafts 34, 35 turn in the respective directions shown by arrows in FIG. 7A, first the printing roll 39*a* reaches its operative position in which it pushes the card 43 against the contiguously adjacent type faces of the two minute wheels 14*a* and 14*b*, and when this pushing is completed, the second printing roll 39*b* pushes the card against the type face of the hour wheel 14*c*, then in the same way the third printing roll 39*c* presses the card toward the type face of the date wheel 14*d*, and finally the fourth printing roll 39*d* presses the card toward the type face of the month wheel 14*e*.

When all of the printing rolls on the shaft 34 have passed through their operative positions, the printing rolls 42*a* and 42*b* on the shaft 35 press the card 43 against the die plate to complete the printing. The shafts 34 and 35 are then returned to the starting positions and stopped.

The driving mechanism for rotating the printing roll shafts 34 and 35 will be described with particular reference to FIGS. 2, 3 and 9 of the drawings.

This driving mechanism comprises a motor 50 which is switched on or off by a switch 51, a worm 52 rotated by the motor, a worm wheel 53 meshing with the worm, a ratchet wheel 55 coaxially fastened to the worm wheel 53, two fixedly joined cam wheels 56 and 57, and a shaft 54 on which the wheels 53, 55, 56 and 57 are rotatably mounted. The universal joint 36 of the printing mechanism is attached to the cam wheel 57, and the other cam wheel 56 is provided with a pawl 68 adapted to transmit rotation of the motor 50 to the cam wheels 56, 57.

Figure 8:
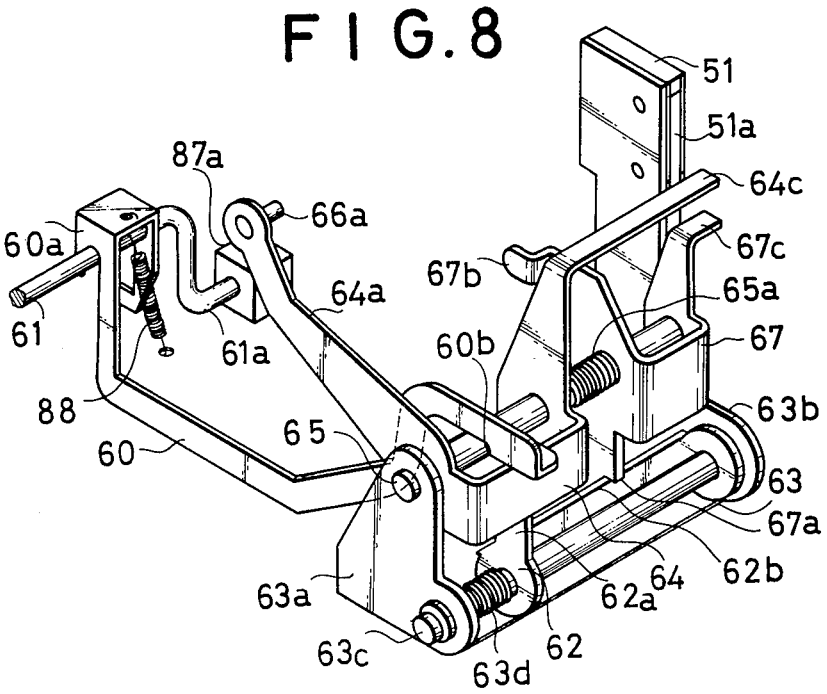
FIG. 8 is a perspective view, with parts cut away, of the driving motor switch.

The switch 51 is actuated by insertion of a printing card 43, and the motor 50 stops after turning the worm 52 one full revolution. The structural details of the motor operating mechanism are shown in FIGS. 8 to 8C. A bar 60 has a hook-shaped end portion 60*a* in which a crank-shaped rod 61 is journaled and, at its other end, a working edge 60*b*. When the rod 61 turns counterclockwise in FIG. 8 upon insertion of the printing card 43, the bar 60 is correspondingly moved to the left, as seen in the same figure.

A bell-crank lever 62 has a longer arm 62*a* terminating in an abutment 62*c* which is engaged by the working edge 60*b* and a shorter arm 62*b*. This lever 62 is pivotally mounted on a shaft 63*c* between two support plates 63*a* and 63*b* of a fixed frame 63. The lever 62 is normally urged to turn clockwise in FIGS. 8 and 8A by a spring 63*d* coiled around the shaft 63*c*. It is turned counterclockwise by the bar 60.

A lever 64 has an arm 64*a* carrying a pin 66*a* adapted to operate the ribbon feed mechanism to be described later, a cam follower arm 64*b* fitted with a roll 66*b* for contact with the cam wheel 57, and an elongated switch operating arm 64*c* adapted to operate the on-off switch 51 of the motor 50. The lever 64 is pivotally mounted on a shaft 65 passing through a central hole 64*d* of the lever between the support plates 63*a*, 63*b* and parallel to the shaft 63*c*. A spring 65*a* coiled around the shaft 65 urges the roll 66*b* against the cam face of the cam wheel 57. When the roll 66*b* is in contact with the peripheral face of the cam wheel 57, the switch operating arm 64*c* depresses the actuator 51*a* of the switch 51 to energize the motor 50, but when the roll 66*b* drops into a recess 57*a* in the periphery of the cam wheel 57, the actuator 51*a* is released to turn the switch off.

A switch operating member 67 is pivotally mounted on the shaft 65 near the lever 64. As best seen in FIGS. 8 and 8C, this switch operating member 67 has an arm 67*a* engaged with the arm 62*a* of the lever 62, a contact arm 67*b* capable of engaging the cam wheel 56, a short switch operating arm 67*c* which controls the switch 51, a stopper arm 67*d* whose function is to be described later, and a hole 67*e* in which the shaft 65 is received. The switch operating member 67 is urged to turn counterclockwise about the shaft 65 in FIG. 8 by the spring 65*a*, but normally, the arm 67*a* is engaged by the arm 62*a* of the lever 62, the contact arm 67*b* is not pressed against the cam wheel 56, and the switch operating arm 67*c* is idle (see FIG. 10A).

Figure 10A:
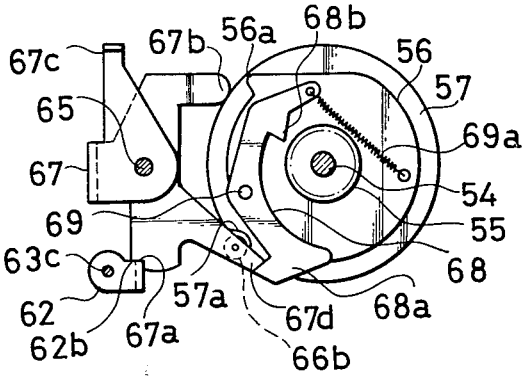
FIGS. 10A to 10C illustrate sequential operating positions of the switch operating member, cam assembly and engaging pawls.
Figure 10B:
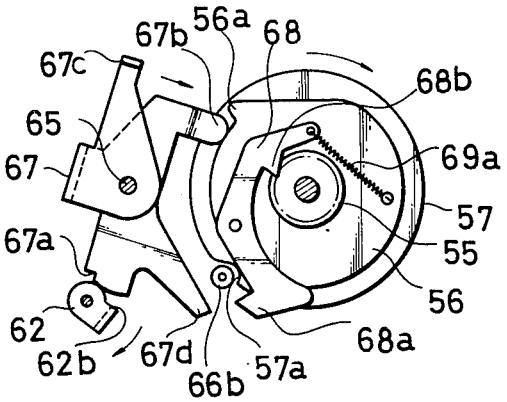

When the bell crank lever 62 is turned by the bar 60, the arms 62*a* and 67*a* are disengaged, the operating member 67 is allowed to turn clockwise (counterclockwise in FIG. 8) about the shaft 65 under the action of the spring 65*a* as shown in FIG. 10B to press the contact arm 67*b* against the peripheral face of the cam wheel 56, while the short switch operating arm 67*c* pushes the actuator 51*a* to energize the motor 50.

At this point, the roll 66*b* on the lever 64 stays in the recess 57*a* in the cam wheel 57 as shown in FIG. 10B, so that the longer switch operating arm 64*c* does not work and hence the starting signal for the motor 50 is given only by the short arm 67*c* of the switch operating member 67. However, when the motor 50 begins to rotate, the roll 66*b* moves out of the recess 57*a* so that the longer switch operating arm 64*c* is also brought to bear on the actuator 51*a*.

Figure 10C:
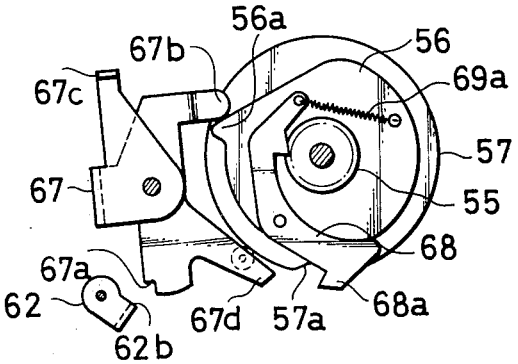

After the cam wheels 56, 57 are turned about 90° by the motor 50, a radial projection 56*a* on the periphery of the cam wheel 56 engages the contact arm 67*b*, causing the switch operating member 67 to turn counterclockwise, as seen in FIG. 10C (clockwise in FIG. 8), about the shaft 65 to release the switch operating arm 67*c* from the actuator 51*a*. However, the long switch operating arm 64*c* of the lever 64 keeps the motor 50 rotating until the roll 66*b* drops into the recess 57*a* in the cam wheel 57. The motor 50 is deenergized after the entire mechanism including the cam wheels has made one full revolution. Because the motor 50, even if switched off, keeps rotating by inertia, there is provided a stopper mechanism constituted by the stopper arm 67*d* of the switch operating member 67 and the pawl 68 pivotally secured to the cam wheel 56 by a pin 69. As shown in FIGS. 10A to 10C, the pawl 68 has one hook-shaped end portion 68*a* and its other end is connected by a spring 69*a* to a side of the cam wheel 56 so that the pawl portion 68*a* is biased to project beyond the peripheral face of the cam wheel 56. The pawl 68 carries a detent 68*b* engageable with the ratchet wheel 55.

Normally, the stopper arm 67*d* is engaged with the pawl portion 68*a* to prevent engagememt between the detent 68*b* and the ratchet wheel 55 (see FIG. 10A) so as not to transmit rotation of the shaft 54 to the cam wheels 56, 57 and further to the printing roll shafts. But when the switch operating member 67 is actuated during switch operation, the stopper arm 67*d* is turned clockwise to release the pawl portion 68*a* as shown in FIG. 10B, so that the pawl 68 is pulled by the spring 69*a* until the detent 68*b* engages the ratchet wheel 55 for transmission of rotation from the ratchet wheel 55 and the shaft 54 to the cam wheels. After one revolution of the cam wheels, the roll 66*b* drops into the recess 57*a* in the cam wheel 57 to turn the switch 51 off, the stopper arm 67*d* is engaged with the pawl portion 68*a* as shown in FIG. 10A to release the detent 68*b* from the ratchet wheel 55. Regardless of inertial rotation of the shaft 54 by the motor 50, the cam wheels 56, 57 as well as the printing roll shafts 34, 35 connected thereto are brought to a stop.

The bell crank lever 62 which had been turned by the bar 60 is returned to its original position by the spring 63*d*, and its arm 62*b* is engaged by the arm 67*a* of the switch operating member 67 to maintain member 67 in its initial position.

The application of the printer device according to the present invention to a time stamp will now be described with reference to FIGS. 1 to 6 of the drawings.

In the drawings, reference numeral 70 designates generally a time stamp comprising a cover 71*b* and a base 71*a* to which the cover is pivotally secured by a shaft 71*c* and which contains the printing mechanism and the driving mechanism. The cover 71*b* is normally locked to the base 71*a* by a locking device including a key 72.

Figure 3:
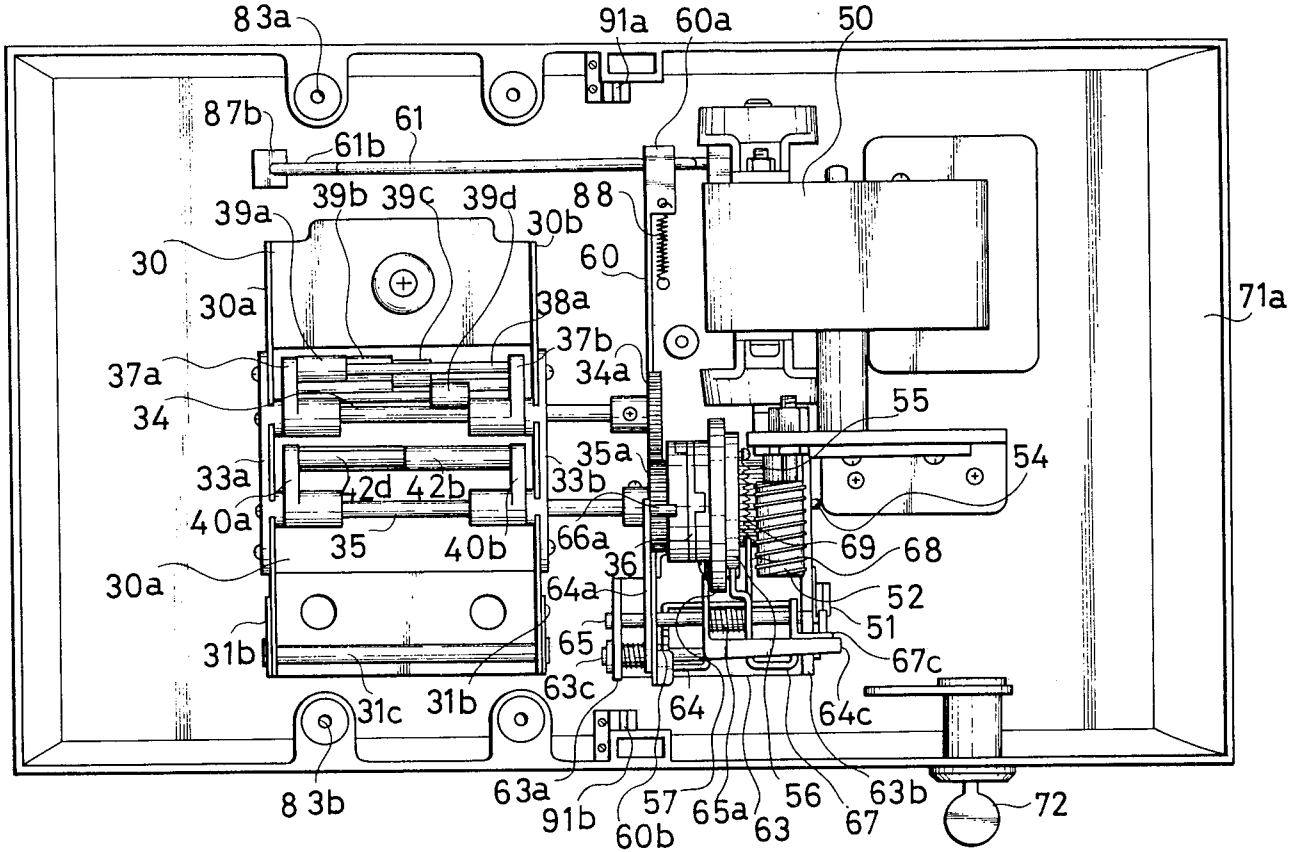
FIG. 3 is a plan view showing the internal mechanism in a principal section of the printer.
Figure 4A:
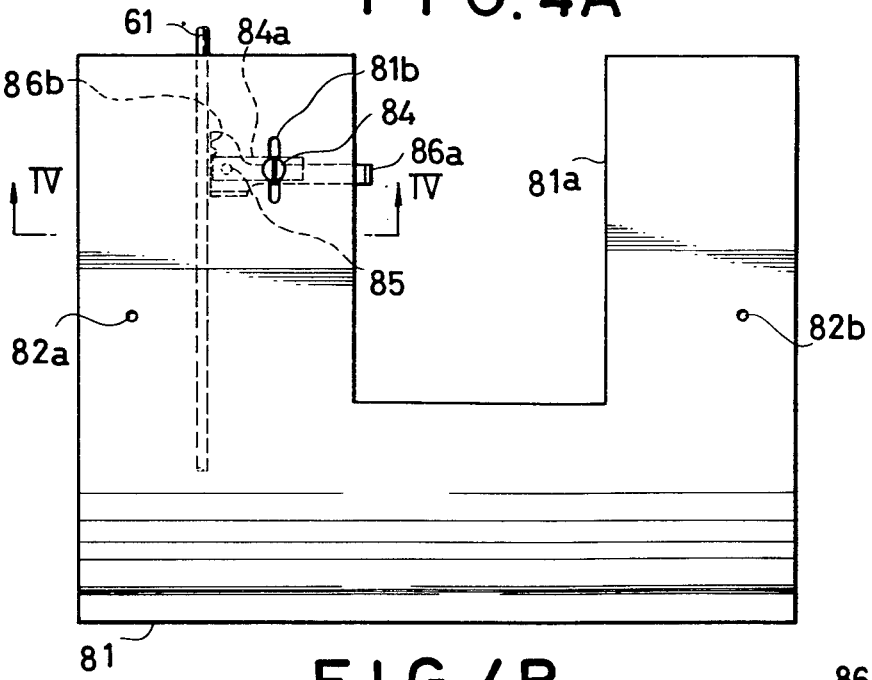
FIG. 4A is a plan view of a guide plate for guiding a printing card.
Figure 4B:
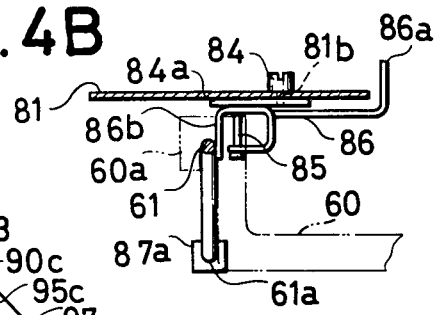
FIG. 4B is a sectional view taken along the line IV — IV of FIG. 4A.

Referring particularly to FIGS. 1 to 4B, numeral 80 indicates a printing card passage between the cover 71*b* and the base 71*a*, and 81 indicates a guide plate of the base 71*a* to guide the card 43 into its printing position in which pressure on respective sides of the card may be exerted simultaneously by one of the type wheels and the radially aligned printing roll. The guide plate 81 is formed with large recess 81*a* in which the printing roll assembly is disposed. Also formed in the plate 81 are holes 82*a*, 82*b* for screws (not shown) securing the guide plate 81 to lugs 83*a*, 83*b* in the base 71*a*. In the plate 81 an elongated slot 81*b* extends in the direction of insertion of the printing card 43 as shown in FIGS. 4A and 4B, and a clamping screw 84 is movably received in the slot and secures a plate 84*a* to the back side of the guide plate 81. A shaft 85 on the plate 84*a* pivotally secures a lever 86 of which one arm 86*a* extends through a recess 81*a* into the passage 80 above the guide plate 81, and the other arm 86*b* abuts against the crank-shaped rod 61. Thus, when the arm 86*a* is engaged by a printing card 43 being inserted into the passage 80, the rod 61 is pushed to the left in FIG. 4A by the other arm 86*b*.

The ends 61*a*, 61*b* of the rod 61 are pivotally supported in bearing portions 87*a*, 87*b* of the base 71*a* as shown in FIGS. 2, 3 and 8. A portion of the rod 61 is received in the end portion 60*a* of the bar 60. A return spring 88 for the bar 60 is disposed between the end portion 60*a* and the base 71*a* as shown in FIG. 8.

The printing block 30 is secured to the base beneath the guide plate 81 by screws 31*a*, 31*a* so that the printing roll assembly is positioned within the recess 81*a*. The frame 63 of the driving mechanism is fixed to the base 71*a* by screws 89*a*, 89*b*. The type mechanism is fixed by the rods 12, 12*b* to a mount 70*a* fastened to the cover 71*b*. The dial plate or face 25 of the clock can be seen through an opening 70*b* formed in the front of the cover 71*b*.

Figure 5:
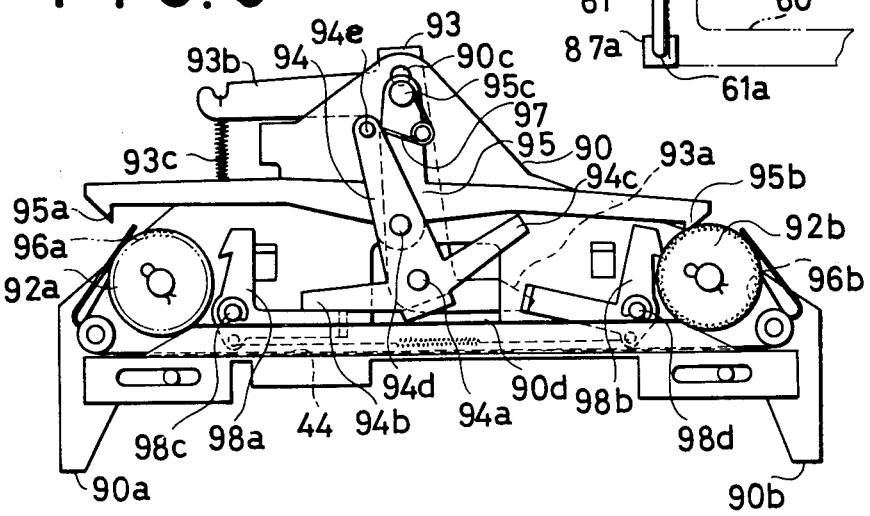
FIG. 5 is a front view of the printing ribbon feed mechanism.

The printing ribbon feed mechanism is indicated by phantom lines in FIGS. 2 and 6, and its detailed arrangement is shown in FIG. 5.

A mounting plate 90 is secured to the base 71*a* by integral plugs 90*a*, 90*b* received in sockets 91*a*, 91*b* in the base 71*a* (see FIG. 3). Two reels 92*a*, 92*b* are positioned on the ends of the printing roll assembly as shown by phantom lines in FIGS. 2 and 6. The printing ribbon 44 wound on the reels 92*a*, 92*b* is partly disposed between the printing card 43 in the passage 80 and the printing rolls and die plate 24.

A lever 93 is swingably secured to the mounting plate 90 by a shaft 90*c* and has an arm 93*a* engaged by the pin 66*a* on the lever 64. When the lever 64 is turned upon insertion of the printing card 43, the lever 93 is also turned about the shaft 90*c* against the restraint of a spring 93*c* disposed between a lever arm 93*b* and the mounting plate 90.

One end of the lever 93 carries a shaft 94*a* which passes through an opening 90*d* in the mounting plate 90 and pivotally supports a switch lever 94 having opposite arms 94*b*, 94*c*. Another shift lever 95 having terminal pawls 95*a*, 95*b* is pivotally joined to yet another arm of the lever 94 by a shaft 94*d*. The shift lever 95 moves with the switch lever 94, and hence with the lever 93, to engage its pawls with respective ratchet wheels 96*a*, 96*b* mounted on the reels 92*a*, 92*b* to thereby turn the reels.

A torsion spring 97 is disposed between a pin 95*c* on the lever 95 and a pin 94*e* on the lever 94. Detents 98*a* and 98*b*, when engaged by the arms 94*b*, 94*c*, are turned about respective pivots 98*c*, 98*d* against the pulling force of a spring to release the ratchet wheels 96*a*, 96*b*.

One of the reels 92*a* or 92*b* is rotated by the shift lever 95 during movement of the lever 93, so as to take up the printing ribbon 44 until the ribbon ends and is stopped, whereupon the switch lever 94 is operated to automatically reverse the feeding direction.

We claim:

1. A printing mechanism comprising:

a. a base;

b. a plurality of type wheels mounted on said base for rotation about a common first axis in axially juxtaposed relationship, each type wheel having a peripheral face and carrying type on said face thereof;

c. a support movably mounted on said base;

d. a printing roll shaft mounted on said support for rotation about a second axis extending in a common direction with said first axis;

e. mounting means on said shaft;

f. a plurality of printing rolls secured to said mounting means for rotation about respective third axes parallel to said second axis in angularly offset relationship,

1. said mounting means maintaining fixed, equal distances between said third axes and said second axis,

2. said printing rolls being axially offset from each other and radially aligned with respective ones of said type wheels,

3. each printing roll moving toward and away from an operative position contiguously adjacent the aligned type wheel during rotation of said shaft;

g. yieldably resilient means biasing said support toward said type wheels;

h. guide means for guiding a card into a printing position, pressure on respective opposite faces of said card being simultaneously exerted by one of said type wheels and the aligned printing roll in the operative position of said aligned printing roll when said card is in said printing position thereof; and i. drive means responsive to movement of said card into said printing position for rotating said shaft.

2. A mechanism as set forth in claim 1, a die plate mounted on said support, another shaft mounted on said base for rotation about a fourth axis extending in said common direction, a plurality of pressure rolls mounted on said other shaft for rotation about respective fifth axes equidistant from and parallel to said fourth axis, each pressure roll moving toward and away from an operative position contiguously adjacent said die plate during rotation of said other shaft, pressure on respective opposite faces of said card, when in said printing position, being simultaneously exerted by said die plate and by one of said pressure rolls in the operative position of said one pressure roll.

* * * * *